US007630190B2

(12) United States Patent
Hamm et al.

(10) Patent No.: US 7,630,190 B2
(45) Date of Patent: Dec. 8, 2009

(54) MECHANISM FOR ADJUSTING AN EARTH ELECTRODE RESISTANCE

(75) Inventors: Valéry Hamm, La Fleche (FR); Yves Mulet-Marquis, La Meignanne (FR)

(73) Assignee: Lacme Holding, La Garenne Colombes (FR)

( * ) Notice: Subject to any disclaimer, the term of this patent is extended or adjusted under 35 U.S.C. 154(b) by 714 days.

(21) Appl. No.: 11/494,676

(22) Filed: Jul. 28, 2006

(65) Prior Publication Data

US 2007/0022855 A1 Feb. 1, 2007

(30) Foreign Application Priority Data

Jul. 29, 2005 (FR) ..... 05 08157
Aug. 18, 2005 (FR) ..... 05 08597

(51) Int. Cl.
*H05C 3/00* (2006.01)

(52) U.S. Cl. ..... 361/232
(58) Field of Classification Search ..... 361/232
See application file for complete search history.

(56) References Cited

U.S. PATENT DOCUMENTS

| | | | | |
|---|---|---|---|---|
| 2,316,211 | A | 4/1943 | Agnew et al. | |
| 4,270,735 | A * | 6/1981 | Gavin | 256/10 |
| 6,398,191 | B1 * | 6/2002 | Forsberg | 256/10 |

FOREIGN PATENT DOCUMENTS

| | | |
|---|---|---|
| DE | 2058311 | 6/1972 |
| EP | 0381585 | 8/1990 |

* cited by examiner

*Primary Examiner*—Stephen W Jackson
(74) *Attorney, Agent, or Firm*—Young & Thompson

(57) ABSTRACT

Mechanism (8) for adjusting the resistance value of an earth electrode (7) connected to an electrification unit (2) of an electric fence (1), includes a control element (13) for causing the resistance value of the earth electrode to vary.

22 Claims, 5 Drawing Sheets

MECHANISM FOR ADJUSTING AN EARTH ELECTRODE RESISTANCE

The subject of the present invention is a mechanism for adjusting the resistance value of an earth electrode connected to an electrification unit of an electric fence.

Electric fences are designed to protect any location from any intrusion or exit of an animal or of a person.

The conventional operation of fence electrification units relies on the use of an earth electrode as a possible return circuit for the punishment pulse that has passed through the body of the animal. One of the problems of existing fences is that, when too much vegetation invades a very long fence, the energy at the end of the line is sometimes insufficient.

In a manner known to those skilled in the art, a fence electrification unit usually has two terminals across which the electric pulse travels. By convention for the remainder of this patent, the powering terminal will be called the high voltage terminal and the second terminal will be called the neutral terminal.

The object of the present invention is to propose a mechanism for adjusting the resistance of an earth electrode used by an electric fence which prevents the aforementioned disadvantage by making it possible, at a given potential imposed at the starting point of the electric fence by an electrification unit, to increase the length of the fence having a sufficient punishment pulse despite the vegetation.

Accordingly, the subject of the invention is a mechanism for adjusting the resistance value of an earth electrode connected to an electrification unit of an electric fence, characterized in that it comprises a control means for causing the resistance value of the earth electrode to vary. The electrification unit may be connected to the earth electrode directly via the adjustment mechanism or indirectly via, for example, a neutral wire of the fence and of the adjustment mechanism. Note therefore that the object of the invention is the adjustment of the earth electrode, seen by the electrification unit, independently of the means of connection between the earth electrode and the electrification unit.

Advantageously, the adjustment mechanism comprises a switch, the control means being capable of actuating the switch into a closed position and into an open position to cause the resistance value of the earth electrode to vary, one of the positions of the switch being equivalent to an earth electrode resistance of infinite value.

According to a particular embodiment of the invention, the adjustment mechanism is external to the electrification unit.

According to a second particular embodiment of the invention, the adjustment mechanism is internal to the electrification unit.

According to a variant of this second embodiment, the adjustment mechanism comprises a specific terminal designed for the connection of an earth wire, capable of being connected at its other end to an earth electrode, the specific terminal being distinct from the neutral terminal.

Advantageously, the control means is capable of controlling the adjustment mechanism so that the specific terminal is substantially at the same electric potential as the neutral terminal.

Preferably, the adjustment mechanism comprises a means of detecting a parameter of the electrification unit or of the fence to which it is connected, the control means being capable of causing the resistance value of the earth electrode to vary according to the value of the parameter.

Advantageously, the adjustment mechanism comprises a comparison means capable of comparing the value of the parameter with p distinct thresholds, p being an integer greater than or equal to 1, the control means being capable of causing the resistance value of the earth electrode to vary when the value of the parameter reaches one of the p thresholds.

According to one embodiment, the parameter is a function of the electric characteristics of the last pulse or pulses emitted by the electrification unit.

According to another embodiment, the parameter is a function of the electric characteristics of the last pulse or pulses present at a particular point of the fence.

According to another embodiment, the parameter is a function of the quantity of vegetation in contact with the high voltage wire(s) of the fence.

Advantageously, the quantity of vegetation is determined by an image processing process.

According to one embodiment of the invention, the control means is capable of causing the resistance value of the earth electrode to vary in response to a command from a user.

Advantageously, the adjustment mechanism comprises a resistor mounted in parallel with a switch, the said control means being capable of actuating the switch into an open position and into a closed position.

Preferably, the adjustment mechanism comprises several adjustment subassemblies mounted in series with one another, each of the said adjustment subassemblies comprising a resistor mounted in parallel with a switch, the said control means being capable of distinctly actuating each of the switches of the adjustment subassemblies into an open position and into a closed position.

According to one embodiment in which the mechanism is external, the adjustment mechanism comprises a first terminal to make it possible to connect the adjustment mechanism to the neutral terminal of the electrification unit, and a second terminal to make it possible to connect to the adjustment mechanism with an earth electrode.

According to another embodiment in which the mechanism is external and connected to an electric fence comprising a high voltage wire and a neutral wire, it comprises a first terminal to make it possible to connect the adjustment mechanism to the said neutral wire, and a second terminal to make it possible to connect the adjustment mechanism to an earth electrode.

Advantageously in the preceding embodiment, the mechanism comprises a third terminal to make it possible to connect the adjustment mechanism to a high voltage wire of the electric fence.

Advantageously, the adjustment mechanism comprises an audible or luminous alarm, the said alarm being capable of being triggered when the switch is actuated into one of the said positions.

Preferably, the adjustment mechanism comprises an audible or luminous alarm, the said alarm being capable of being triggered according to the quantity of vegetation in contact with the high voltage wire(s) of the fence.

A further subject of the invention is an electric fence electrification unit, characterized in that it comprises a mechanism for adjusting the resistance value of the earth electrode seen by the electrification unit.

A further subject of the invention is a transponder or accessory of an electric fence connected to an earth electrode, characterized in that it comprises a mechanism for adjusting the resistance value of the earth electrode seen by the electrification unit.

The invention will be better understood and other objects, details, features and advantages of the latter will appear more clearly during the following detailed explanatory description of several embodiments of the invention given as purely illustrative and non-limiting examples, with reference to the appended schematic drawings.

Figure 1:
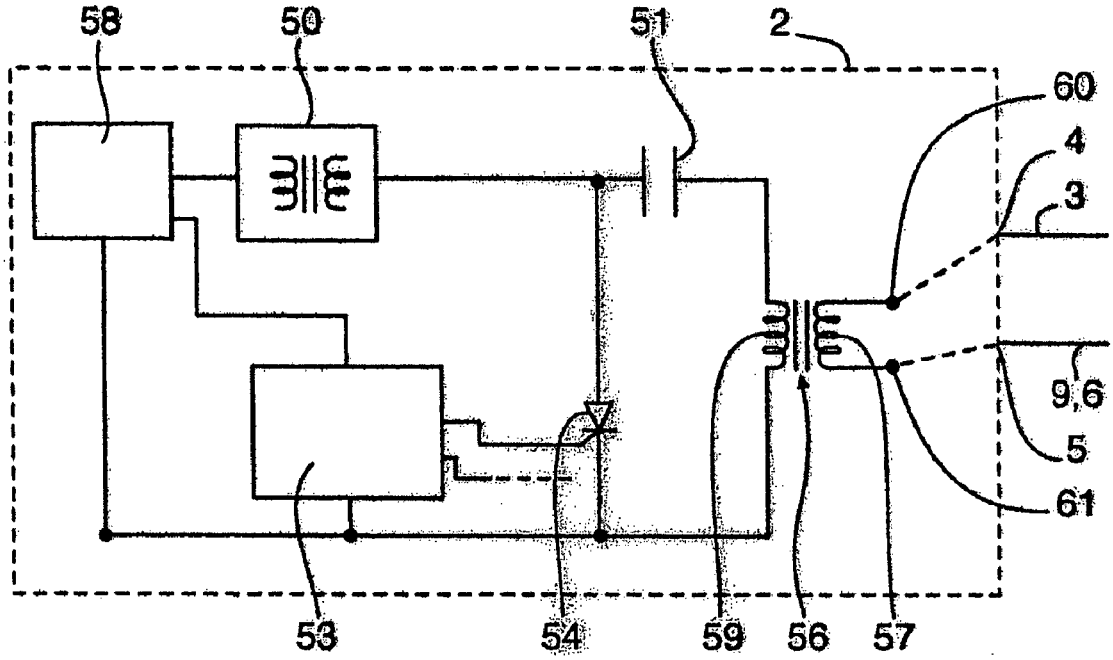
FIG. 1 is a simplified schematic view of an electric fence electrification unit.

With reference to FIG. 1, an electrification unit 2, that has been shown schematically in dashed lines, comprises a step-up voltage transformer 50 to load a capacitor 51 to a voltage of several hundred volts. The step-up voltage transformer 50 is supplied by an energy source 58 that may be, for example, the low voltage mains, an accumulator or a battery. At the command from a control circuit 53, which may be a microcontroller, a thyristor 54 is turned into a conductor with a period of the order of one second. When the thyristor 54 is made into a conductor, the capacitor 51 discharges through the thyristor and the primary 59 of an output transformer 56. The effect of this is that the secondary 57 of the output transformer 56, that is connected, on the one hand, at 60 to a high voltage terminal 4, and, on the other hand, at 61 to a neutral terminal 5, delivers, via the high voltage terminal 4, to one or more fence wires, called high voltage wire(s) 3 in the rest of the text, a pulse of high voltage (several thousand volts) and of calibrated energy. Such an electrification unit, which complies with the standard 335-2-76, is known per se.

Figure 2:
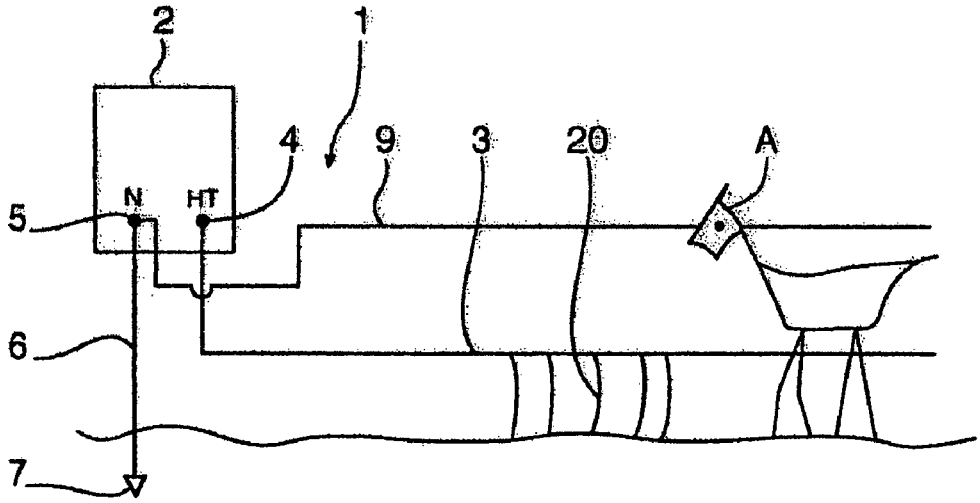
FIGS. 2 and 3 are simplified schematic views of an electric fence comprising the electrification unit of FIG. 1, before and after the installation of an external mechanism for adjusting a resistance of an earth electrode.

FIG. 2 shows an electric fence 1 comprising an electrification unit 2.

The neutral terminal 5 is designed to be connected via an earth wire 6 to an earth electrode 7, and/or to one or more fence wires called neutral wire(s) 9 in the rest of the text. For the purpose of clarity, only one neutral wire 9 and one high voltage wire 3 have been represented in the figures and are used in the rest of the description, but it is clear that the fence 1 may comprise several neutral wires 9, connected to the neutral terminal 5, and/or several high voltage wires 3, connected to the high voltage terminal 4.

The general principle of the electric fence is that a very brief punishment pulse is delivered approximately once per second by the high voltage terminal of the electrification unit. It is propagated along the high voltage wire(s) 3 seeking to return to the neutral terminal 5 of the electrification unit 2 via all possible paths (vegetation, faulty insulators, animal in contact with the fence) which the latter conclude by travelling through the earth electrode or through the neutral wire(s) 9.

Figure 3:
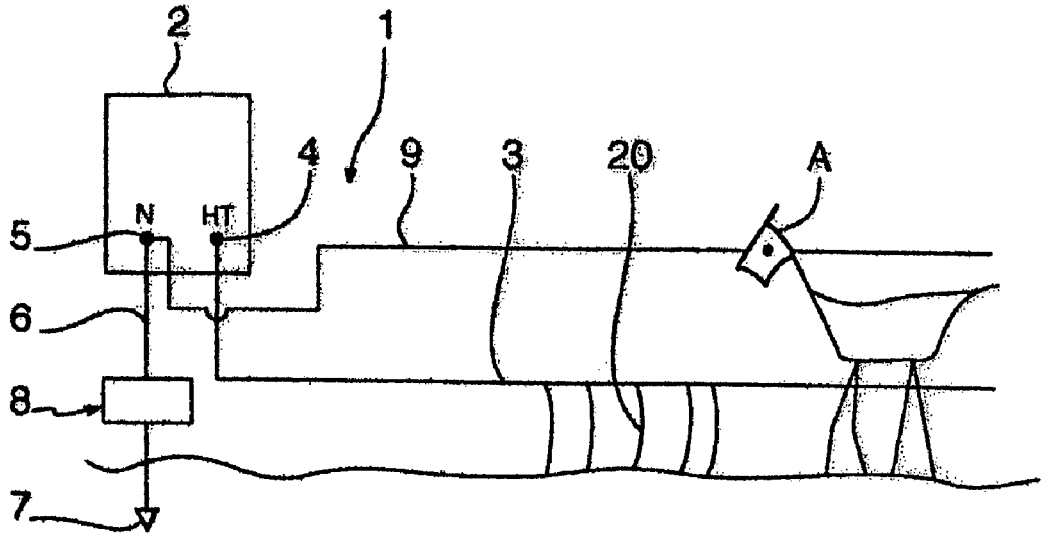

With reference to FIG. 3, the neutral terminal 5 is connected to the earth wire 6 that is this time connected to the earth electrode 7 via an adjustment mechanism 8. The adjustment mechanism 8 has the function of adjusting the resistance of the electrode of the electrification unit 2 as described in detail hereinafter.

When the electrification unit 2 delivers a pulse in the high voltage wire, fractions of the pulse travel into any grass or vegetation 20 that touches the high voltage wire 3. The repeated action of these pulse fractions over a large number of consecutive pulses, for example thousands, leads to progressively destroying this vegetation by desiccation. When certain plants simultaneously touch the high voltage wire 3 and the neutral wire 9, a fraction of the pulse also returns to the electrification unit 2 via the neutral wire 9. The high voltage wire 3 is therefore sometimes placed close to the ground, beneath the neutral wire 9, to optimize the destruction of the first shoots of grass or plants.

Figure 4:
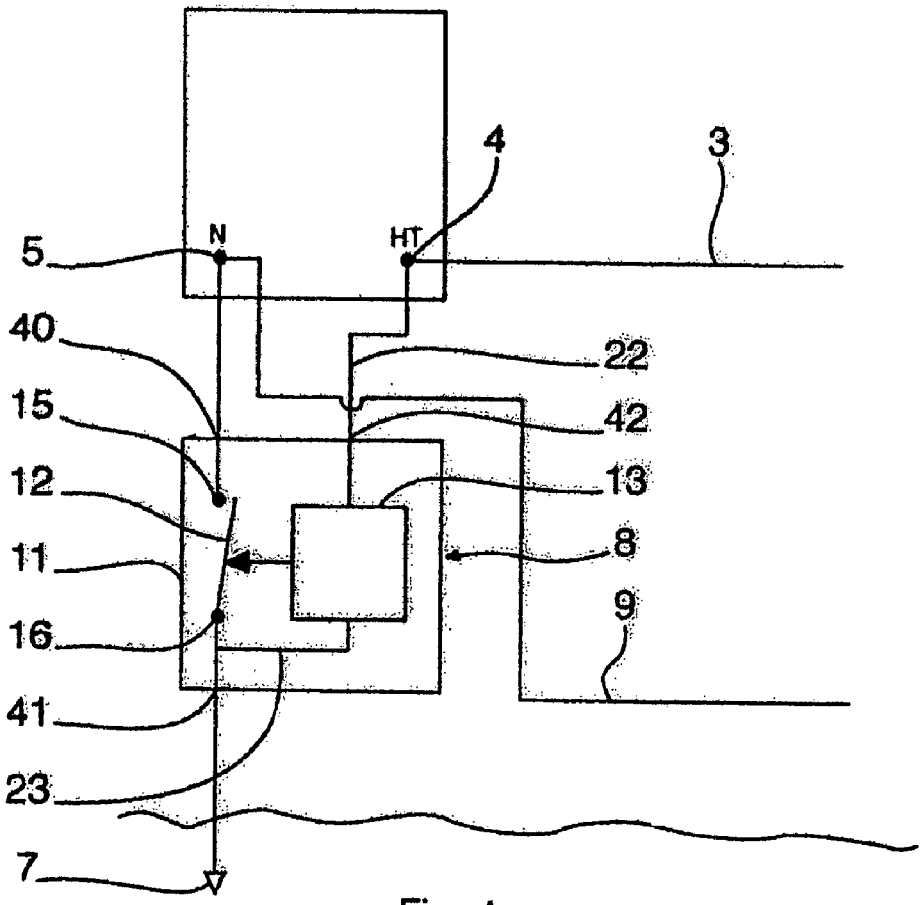
FIG. 4 is a simplified schematic view of a mechanism for adjusting a resistance of an earth electrode of the electrification unit of FIG. 3, according to one embodiment of the invention.

FIG. 4 shows the adjustment mechanism 8 in greater detail. In this embodiment, the adjustment mechanism 8 is housed in a case 11 independent of that of the electrification unit 2, which makes it possible simply and economically to adapt the adjustment mechanism 8 to an existing installation. The adjustment mechanism 8 comprises a switch 12, that can be actuated between a closed position and an open position, and a control means 13. The control means 13 comprises a relay (not shown) comprising a coil placed close to the switch 12 so that, when the coil is live, the switch 12 closes, and when the coil is not live, the switch 12 opens. The control means 13 comprises a microcontroller capable of controlling the supply of the coil, to allow the opening and the closing of the switch 12. The adjustment mechanism 8 may comprise a visual or audible indicator (not shown), for example an LED, making it possible to indicate to a user whether the switch 12 is open or closed.

The case 11 is placed so that a terminal 40 of the adjustment mechanism 8, connected to a terminal 15 of the switch 12, is connected to the neutral terminal 5 and so that a terminal 41 of the adjustment mechanism 8, connected to the second terminal 16 of the switch 12, is connected to the earth electrode 7.

The adjustment mechanism 8 is supplied by any means, for example by a solar panel, a battery, the mains or by taking energy from the fence.

The control means 13 comprises a detector (not shown) connected to the high voltage terminal 4 or directly to the high voltage wire 3, via a wire 22 connected to a terminal 42 of the adjustment mechanism 8. The detector is connected to the terminal 16, via an electric track 23. The detector is capable of determining a parameter of the fence 1. For example, the detector detects the average energy of the last pulses. The control means 13 comprises an analysis device (not shown), connected to the detector, capable of receiving data transmitted by the detector and of transmitting an item of information relating to the modification of the parameter of the fence 1.

Figure 5:
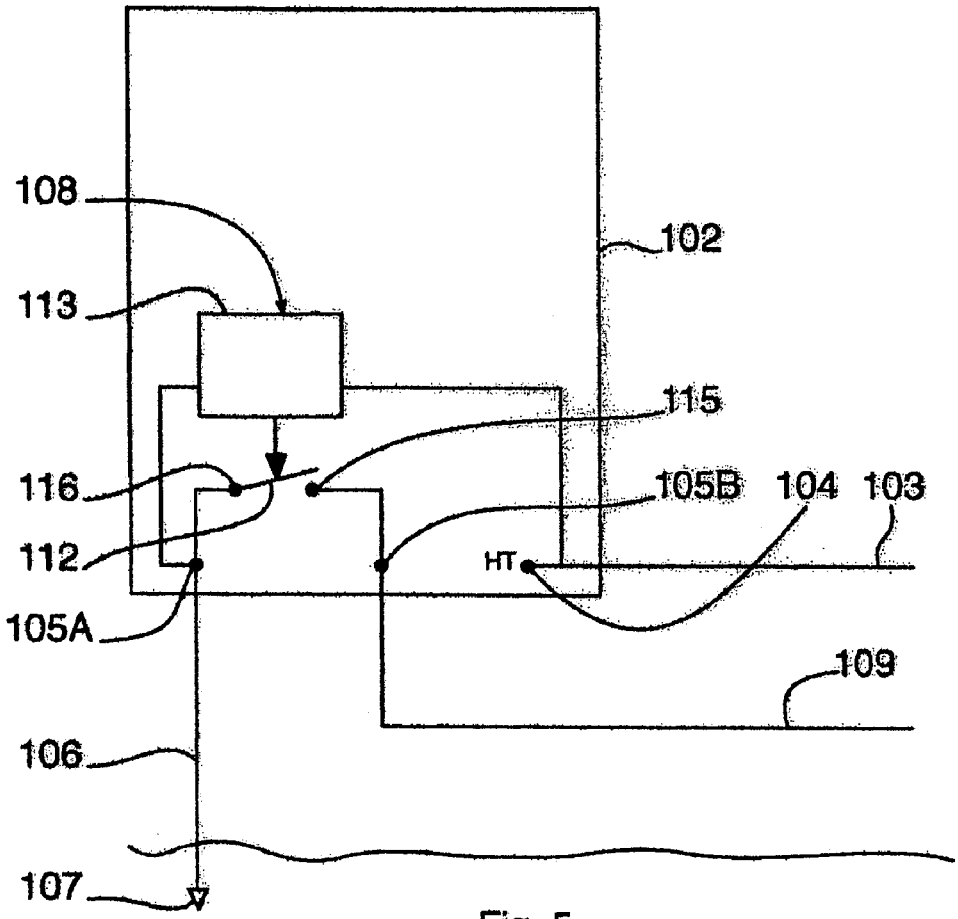
FIG. 5 is a simplified schematic view of an adjustment mechanism internal to an electrification unit, according to a second embodiment of the invention.

With reference to FIG. 5, a second embodiment will now be described. The elements of the adjustment mechanism and of the electrification unit that are identical to the first embodiment are indicated by the same reference number increased by 100 and are not described again. Here, the electrification unit 102 comprises a high voltage terminal 104 and a neutral terminal 105B for the connection of the neutral wire 109. The adjustment mechanism 108 is internal to the electrification unit 102 and comprises a specific terminal 105A for the connection of an earth wire 106 to the earth electrode 107.

The terminal 116 of the switch 112 is connected to the specific terminal 105A and the terminal 115 of the switch 112 is connected to the neutral terminal 105B, so that, when the switch 112 is closed, the terminals 105A and 105B are substantially at the same potential.

With reference to FIGS. 3, 4, 7 and 8, the operation of the adjustment mechanism 8 according to the first embodiment will now be described. The operation of the adjustment mechanism 108 according to the second embodiment is identical.

Initially, the switch 12 (respectively 112) is closed, which corresponds to normal operation. The electrification unit 2 (respectively 102) delivers a pulse to the high voltage wire 3 (respectively 103).

Figure 7:
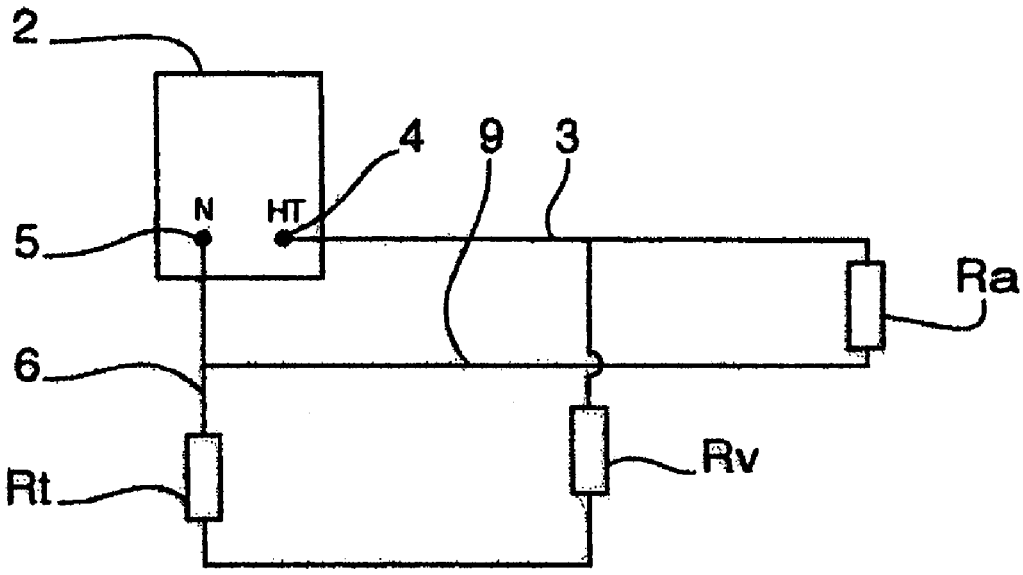
FIG. 7 is a simplified wiring diagram representing the electric fence of FIG. 3.

At this moment, if an animal A, symbolized by a resistor Ra in FIG. 7, is in contact with the high voltage wire 3 (respectively 103), it is traversed by the pulse, which returns to the electrification unit 2 both via the earth electrode 7 and via the neutral wire 9 if the animal A simultaneously touches the neutral wire 9. In FIG. 7, the earth electrode is symbolized by a resistor Rt. In this figure, it was considered that the animal A touched the high voltage wire 3 at the same time as the neutral wire 9, and that the return of the pulse to the electrification unit 2 via the earth electrode 7 could be neglected. The high voltage wire 3 has been shown above the neutral wire 9 to simplify the wiring diagram, although it is beneath the neutral wire 9 in the fence 1.

As has been described hereinabove, when plants 20 grow close to the fence 1 and are in contact with the high voltage wire 3 (respectively 103), a fraction of the electric pulse passes through the plants 20, the earth electrode providing the return circuit to the electrification unit. This is reflected by the appearance of an electric loss resistor Rv between the high voltage wire 3 (respectively 103) and the earth. The resistor Rv is in series with the resistor Rt, both the resistors Rv and Rt being in parallel with the resistor Ra. The current of the pulse passing through the animal A is then:

$Ia=I*(Rt+Rv)/(Ra+Rt+Rv)$, I being the current of the pulse delivered to the high voltage wire 3 (respectively 103).

When the number of plants increases, and the pulses are no longer sufficient to dry them, the resistor Rv diminishes, that is to say that the fraction of the pulse passing through the plants 20 increases, and therefore the current Ia of the pulse passing through the animal A diminishes. The effect of this is to reduce the effectiveness of herding.

The analysis device calculates or estimates the value of the resistor Rv. When the resistor Rv becomes less than a predefined threshold S1, for example situated between 300 and 500 ohms, the control means 13 (respectively 113) controls the opening of the switch 12 (respectively 112). The open switch 12 (respectively 112) corresponds to an infinite resistance value of the earth electrode 7.

Figure 8:
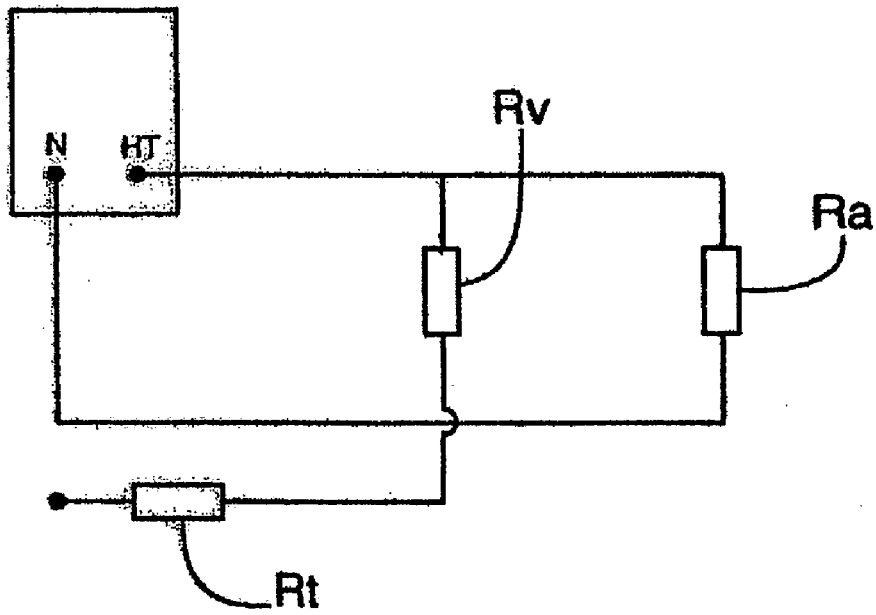
FIG. 8 is a diagram similar to FIG. 7, the earth electrode having been disconnected.

The wiring diagram corresponding to the open switch 12 (respectively 112) is represented in FIG. 8. When the switch 12 (respectively 112) is open, the neutral wire 9 (respectively 109) is disconnected from the earth electrode 7 (respectively 107). In this case, the plants 20 that touch only the high voltage wire 3 do not take a fraction of the pulse, because, since the earth electrode 7 has been disconnected, there is no possible return to the neutral terminal 5 of the electrification unit 2 through them.

Note that, if plants simultaneously touch the high voltage wire 3 (respectively 103) and the neutral wire 9 (respectively 109), these plants take a fraction of the pulse, the return to the electrification unit 2 (respectively 102) of this fraction being achieved in this case via the neutral wire 9 (respectively 109). These particular plants, in this case, undergo the desiccating action of the pulses.

Only the small proportion of the vegetation that simultaneously touches the high voltage wire 3 and the neutral wire 9 (respectively 103 and 109) takes a fraction of the pulse, which makes it possible to greatly reduce the impact of the vegetation.

Experience shows that, in general, the greater the distance of a neutral wire 9 (respectively 109) from a high voltage wire 3 (respectively 103) the smaller the proportion of the vegetation simultaneously touching these two wires 3 and 9 (respectively 103 and 109) and there is consequently an advantage, during a new installation, in slightly offsetting the vertical plane associated with the high voltage wire(s) 3 from that associated with the neutral wire(s) 9.

The device as described therefore makes it possible to retard the growth of the plants on the fence 1 by drying the first shoots, then, when the vegetation reaches its annual paroxysm, makes it possible to limit the impact of the vegetation on the performance of the electric fence by disconnecting the earth electrode 7 (respectively 107).

Beginning in this situation, when the resistor Rv, later in the year, again becomes of greater value than a predefined threshold S2, the control means 13 (respectively 113) controls the closing of the switch 12 (respectively 112). At this time, the neutral wire 9 (respectively 109) is again connected to the earth electrode 7 (respectively 107).

Thus, the control module 13 (respectively 113) controls the supply or disconnection of supply, respectively, of the coil, and consequently the closing or opening respectively of the switch 12 (respectively 112) and thus the connection or disconnection, respectively of the earth electrode 7 (respectively 107).

Note that it is worthwhile retaining the connection between the electrification unit 2 (respectively 102) and the earth electrode 7 (respectively 107) so long as this does not excessively influence the effectiveness of the pulse passing through the animal A, because the connection of the earth electrode 7 (respectively 107) makes it possible, in addition to drying the first shoots of grass, to increase the safety of the system, particularly when the animal A touches only the high voltage wire 3 (respectively 103) without simultaneously touching the neutral wire 9 (respectively 109). The adjustment means 8 (respectively 108) therefore makes it possible to disconnect the earth electrode 7 (respectively 107) only when it is absolutely necessary.

Figure 6:
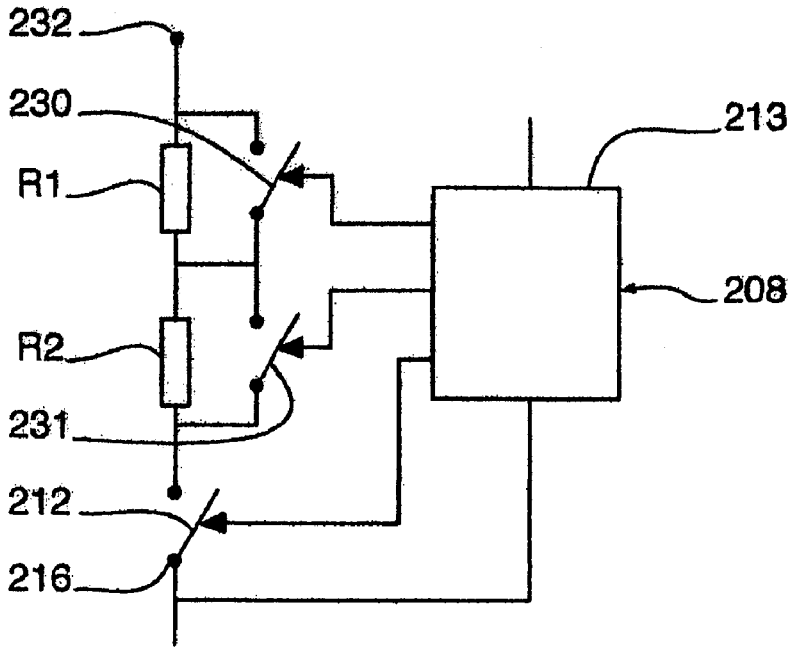
FIG. 6 is a simplified schematic view showing a variant of the adjustment mechanism.

With reference to FIG. 6, a variant of the adjustment mechanism will now be described. The elements of the adjustment mechanism that are identical to the first embodiment are indicated by the same reference number increased by 200 and are not described again.

Here, the adjustment mechanism 208 comprises two resistors R1 and R2 mounted in series with the switch 212. For example R1=100 ohms and R2=1000 ohms. Each of the resistors R1 and R2 is mounted in parallel with a switch 230 and 231 respectively. The control means 213 is capable of controlling each of the switches 212, 230, 231 into an open position and into a closed position.

In the situation in which the adjustment mechanism 208 is external to the electrification unit, as described in the first embodiment, it is inserted in a case (not shown in FIG. 6) similar to the case 11 of FIG. 4, the terminal 41 of the adjustment mechanism 208, connected to the terminal 216 of the switch 212, being connected to the earth electrode 7 and the terminal 40 of the adjustment mechanism 208, connected to the terminal 232 of the resistor R1, being connected to the neutral terminal 205.

In the case where the adjustment mechanism 208 is internal to an electrification unit as described in the second embodiment, the terminal 216 of the switch 212 is connected to the specific terminal 105A and the terminal 232 of the resistor R1 is connected to the neutral terminal 105B.

This variant makes it possible progressively to modify the value of earth resistance, by selectively controlling the opening and the closing of each of the switches 212, 230 and 231.

The operation of the adjustment mechanism 208 will now be described. Initially, the three switches 212, 230 and 231 are closed.

The analysis device calculates the value of the resistor Rv. When the resistor Rv reaches a lower value than a predefined threshold S4, the control means 213 controls the opening of the switch 230, the switches 212 and 231 remaining closed. In this case, the earth resistance increases by the value of the resistor R1, for example 100 ohms.

Beginning in this state, when the resistor Rv reaches a lower value than a threshold S5, S5<S4, the control means 213 controls the opening of the switch 231, the switch 212 remaining closed. In this case, the earth resistance increases by the value of the resistor R2, for example 1000 ohms.

When the resistor Rv reaches a lower value than a threshold S6, S6<S5, the control means 213 controls the opening of the switch 212. In this case, the neutral wire is disconnected from the earth electrode, which is equivalent to an infinite resistance value of the earth electrode, as has been described previously.

Similarly, when, later in the year, the resistor Rv increases in value, the control means 213 controls the closing of one or more of the switches 212, 230 and 231. Note that the number of resistors mounted in parallel with a switch respectively is not necessarily equal to 2 but may be equal to p, p being any positive integer. The operation of such an adjustment mechanism being similar to the case previously described.

Figure 9:
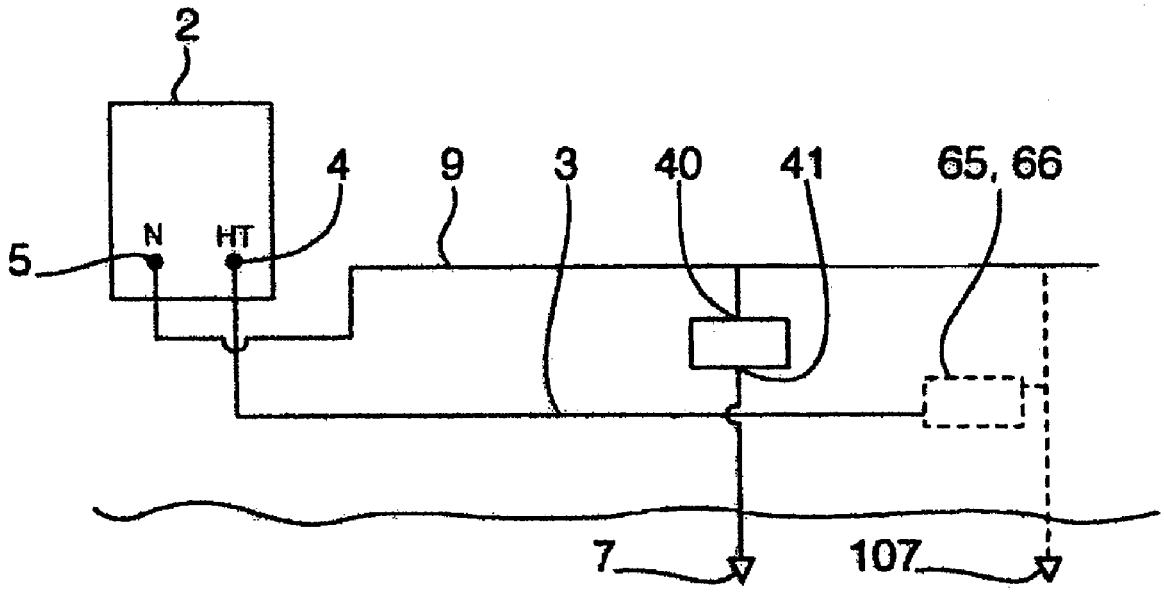
FIG. 9 is a simplified schematic view of an electric fence, the adjustment mechanism being connected to the neutral wire or incorporated into a transponder or incorporated into an electric fence accessory connected to an earth electrode.

In the embodiments previously described, when the adjustment mechanism 8 is external to the electrification unit, it is connected, on the one hand, to the electrification unit 2 via the terminal 40 and, on the other hand, to the earth electrode 7 via the terminal 41. In this case, the electrification unit 2 is connected directly to the earth electrode 7 via the adjustment mechanism 8. However, it is clear to those skilled in the art that the earth electrode may be slaved (FIG. 9) and that it is equivalent to connecting the terminal 40 of the adjustment mechanism 8 to a point of the neutral wire 9, the terminal 41 being connected to the slaved earth electrode, the neutral wire 9 being connected to the neutral terminal 5 of the electrification unit, as represented in a solid line in FIG. 9. In this case, the electrification unit 2 is indirectly connected to the earth electrode 7, that is to say via the neutral wire 9 and the adjustment mechanism 8. Thus, the object of the invention is clearly to make it possible to adjust the earth electrode seen by the electrification unit independently of the means of connection between the earth electrode and the electrification unit.

Other variants are possible. For example, the slaved earth electrode may be that used by a transponder 65 placed at a distant point on a high voltage wire and returning a signal dependent on the pulse that passes through it. The earth electrode may also be that of any other accessory connected to the electric fence and using an earth electrode. In this case, as a variant of the second embodiment, an adjustment mechanism similar to the adjustment mechanism 108 may be incorporated into the transponder 65, or into the accessory 66, as shown in dashed lines in FIG. 9. The result of this is to indirectly connect the electrification unit 2 to the earth electrode 107 via the transponder 65 or the accessory 66 and the neutral wire 5.

The detector of the adjustment mechanism 8 may be in relation with a transponder placed at a distant point on the electric fence. The principle of the transponder is known to those skilled in the art (see, for example, patent EP 0 381 585) and allows the detector to detect the electric characteristics of the last pulse or pulses present at this particular point of the electric fence. Certain of these characteristics, such as the pulse voltage at this point, are a function of the amount of vegetation in contact with the high voltage wire(s) of the fence.

As an alternative, the detector may be, or be linked to, an optical detector, where necessary slaved, making it possible to obtain an image of the vegetation in contact with the fence, and to monitor it over a year, the analysis device being capable of comparing this image with a stored image to decide whether a switch must be closed or opened.

The adjustment mechanism 8 may have a manual control means (not shown) allowing a user to manually control the opening and closing of the switch 12, independently of the parameter detected by the detector. This manual control may replace or be combined with the detector and the analysis device. The manual control means may be, for example, a control button provided on the case 11, or else a remote control means, for example a remote control or a telephone.

The adjustment mechanism 8 may comprise an alarm, for example of an audible or luminous nature, alerting the user when the resistor Rv becomes too low.

Although the invention has been described in relation to several particular embodiments, it is clear that it is in no way limited thereto and that it comprises all the technical equivalents of the means described and their combinations if the latter enter into the scope of the invention.

The invention claimed is:

1. Mechanism (8, 108, 208) for adjusting the resistance value of an earth electrode (7, 107) connected to an electrification unit (2, 102) of an electric fence (1), characterized in that it comprises a control means (13, 113, 213) for causing the resistance value of the earth electrode to vary.

2. Adjustment mechanism according to claim 1, characterized in that it comprises a switch (12, 112, 212), the said control means (13, 113, 213) being capable of actuating the said switch (12, 112, 212) into a closed position and into an open position to cause the resistance value of the earth electrode to vary, one of the positions of the said switch being equivalent to an earth electrode resistance of infinite value.

3. Adjustment mechanism (8, 208) according to claim 1, characterized in that it is external to the electrification unit.

4. Adjustment mechanism (108, 208) according to claim 1, characterized in that it is internal to the electrification unit.

5. Adjustment mechanism (108, 208) according to claim 4, connected to an electrification unit (102) comprising a high voltage terminal (104) and a neutral terminal (105B), characterized in that the said adjustment mechanism comprises a specific terminal (105A) designed for the connection of an earth wire (106), capable of being connected at its other end to an earth electrode (107), the said specific terminal being distinct from the said neutral terminal.

6. Adjustment mechanism according to claim 5, characterized in that the said control means (113, 213) is capable of controlling the adjustment mechanism so that the said specific terminal (105A) is substantially at the same electric potential as the said neutral terminal (105B).

7. Adjustment mechanism according to claim 1, characterized in that it comprises a means of detecting a parameter of the electrification unit or of the fence to which it is connected, the said control means (13, 113, 213) being capable of causing the resistance value of the earth electrode to vary according to the value of the said parameter.

8. Adjustment mechanism according to claim 7, characterized in that it comprises a comparison means capable of comparing the value of the said parameter with p distinct thresholds, p being an integer greater than or equal to 1, the control means being capable of causing the resistance value of the earth electrode to vary when the value of the said parameter reaches one of the said p thresholds.

9. Adjustment mechanism according to claim 7, characterized in that the said parameter is a function of the electric characteristics of the last pulse or pulses emitted by the electrification unit.

10. Adjustment mechanism according to claim 7, characterized in that the said parameter is a function of the electric characteristics of the last pulse or pulses present at a particular point of the fence.

11. Adjustment mechanism according to claim 7, characterized in that the said parameter is a function of the quantity of vegetation in contact with the high voltage wire(s) of the fence.

12. Adjustment mechanism according to claim 11, characterized in that the quantity of vegetation is determined by an image processing process.

13. Adjustment mechanism according to claim 1, characterized in that the said control means (13, 113, 213) is capable of causing the resistance value of the earth electrode to vary in response to a command from a user.

14. Mechanism according to claim 1, characterized in that it comprises a resistor (Rl) mounted in parallel with a switch (230), the said control means (213) being capable of actuating the switch (230) into an open position and into a closed position.

15. Adjustment mechanism according to claim 1, characterized in that it comprises several adjustment subassemblies mounted in series with one another, each of the said adjustment subassemblies comprising a resistor (R1, R2) mounted in parallel with a switch (230, 231), the said control means (213) being capable of distinctly actuating each of the switches (230, 231) of the adjustment subassemblies into an open position and into a closed position.

16. Adjustment mechanism (8, 208) according to claim 3, connected to an electrification unit (2) comprising a high voltage terminal (4) and a neutral terminal (5), characterized in that the said adjustment mechanism comprises a first terminal (40) to make it possible to connect the adjustment mechanism to the said neutral terminal of the electrification unit, and a second terminal (41) to make it possible to connect the adjustment mechanism to an earth electrode.

17. Adjustment mechanism (8, 208) according to claim 3, connected to an electric fence comprising a high voltage wire (3) and a neutral wire (9), characterized in that the said adjustment mechanism comprises a first terminal (40) to make it possible to connect the adjustment mechanism to the said neutral wire, and a second terminal (41) to make it possible to connect the adjustment mechanism to an earth electrode.

18. Adjustment mechanism according to claim 16, characterized in that the adjustment mechanism comprises a third terminal (42) to make it possible to connect the adjustment mechanism to a high voltage wire (3) of the electric fence.

19. Adjustment mechanism according to claim 2, characterized in that it comprises an audible or luminous alarm, the said alarm being capable of being triggered when the switch is actuated into one of the said positions.

20. Adjustment mechanism according to claim 11, characterized in that it comprises an audible or luminous alarm, the said alarm being capable of being triggered according to the quantity of vegetation in contact with the high voltage wire(s) of the fence.

21. Electric fence electrification unit, characterized in that it comprises a mechanism for adjusting the resistance value of the earth electrode seen by the electrification unit according to claim 1.

22. Transponder (65) or accessory (66) of an electric fence connected to an earth electrode, characterized in that it comprises a mechanism for adjusting the resistance value of the earth electrode seen by the electrification unit according to claim 1.

* * * * *

UNITED STATES PATENT AND TRADEMARK OFFICE

CERTIFICATE OF CORRECTION

PATENT NO. : 7,630,190 B2
APPLICATION NO. : 11/494676
DATED : December 8, 2009
INVENTOR(S) : Hamm et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 802 days.

Signed and Sealed this

Twenty-first Day of December, 2010

David J. Kappos

David J. Kappos
*Director of the United States Patent and Trademark Office*